United States Patent [19]

Marsh

[11] 4,299,246

[45] Nov. 10, 1981

[54] WALKING AIDS

[76] Inventor: John W. K. Marsh, "North Lodge", Fawkham Manor, Fawkham, Dartford, Kent, England

[21] Appl. No.: 131,566

[22] Filed: Mar. 19, 1980

[30] Foreign Application Priority Data

Mar. 21, 1979 [GB] United Kingdom ..... 094846/79
Apr. 27, 1979 [GB] United Kingdom ..... 914662/79

[51] Int. Cl.[3] ..... A45B 3/00
[52] U.S. Cl. ..... 135/66
[58] Field of Search ..... 135/65, 66, 67, 68, 135/84, 81, 80, 75, 70, 69

[56] References Cited

U.S. PATENT DOCUMENTS

| | | | |
|---|---|---|---|
| 1,270,973 | 7/1918 | Rosenwasser | 135/65 X |
| 1,905,076 | 4/1933 | Van Sciver | 135/66 |
| 2,346,038 | 4/1944 | Mason | 135/66 X |
| 2,836,188 | 5/1958 | Jordan | 135/66 |
| 3,392,946 | 7/1968 | Stromberg | 135/84 X |
| 3,467,116 | 9/1969 | Ringewaldt | 135/66 X |
| 3,763,872 | 10/1973 | Gooley | 135/66 |
| 4,062,372 | 12/1977 | Slusher | 135/66 |

FOREIGN PATENT DOCUMENTS

| | | | |
|---|---|---|---|
| 2342679 | 9/1977 | France | 135/66 |

*Primary Examiner*—J. Karl Bell

[57] ABSTRACT

A walking aid such as a walking stick, crutch or walking frame comprises a body, a ground engaging member mounted at one end of the body, the body being movable relative to the ground engaging member, and a lever pivotably mounted on said ground engaging member, the body having means to actuate the lever so as to cause pivotal movement of the lever when the body moves relative to the ground engaging member. This pivotal movement of the lever can be utilized for retrieving objects on the ground, with the lever and ground engaging member acting as gripping members. A locking ring may be provided for preventing relative movement of the body and ground engaging member when the object retrieving facility is not required.

6 Claims, 3 Drawing Figures

WALKING AIDS

FIELD OF THE INVENTION

This invention relates to walking aids such as walking sticks, crutches and walking frames, of the type which will enable the user to retrieve objects on the ground or on a floor without recourse to bending, this being of particular benefit to the elderly, infirm or disabled.

BACKGROUND OF THE INVENTION

British Patent No. 643,047 (Thorne) discloses a gripping device for attachment to a walking aid near a ground-engaging part thereof. The device comprises a pair of jaws, namely a rigid jaw and a resilient blade or jaw rigidly secured at its upper end to the rigid jaw and outwardly bowed so that normally the lower end of the blade is urged into contact with the lower end of the rigid jaw. The resilient blade has a lower anchorage for an operating member by which the spring may be flexed away from the rigid jaw in order to grip therebetween an article to be lifted or manipulated. The operating member disclosed is a cable secured by the lower anchorage at one end and connected to a ring at its other end adjacent the handle of the walking aid.

British Pat. No. 998,788 (Colbert) discloses a walking aid including a handle, a stem having a ground engaging portion and a finger pivotably mounted on the stem adjacent the ground-engaging portion. The finger is spring loaded into gripping engagement with the ground-engaging portion and an operating member comprising a trigger is provided on the stem adjacent the handle and connected to the finger by means of a wire or cable so that the finger can be moved away from the groundengaging portion against the action of the spring. The stem is hollow to accommodate most of the length of the wire or cable.

Both Thorne and Colbert have the disadvantage that persons suffering from arthritis and/or rheumatism may have difficulty operating rings or triggers with their fingers. Thorne discloses a structure which lies outside the body of the walking aid and is subject to damage and/or wear. Colbert involves drilling holes in the hollow stem to locate most of the wire or cable therewithin. Neither Thorne or Colbert disclose any means for preventing accidental operation of the operating member.

British Pat. No. 235,111 (Bonneault) discloses an appliance for setting or sowing small seeds in groups which bears some resemblance to a walking stick. The appliance has a handle and a hollow stem which has a lower opening closed by a cover resiliently biased against the stem. The cover is rigidly attached to an arm which carries a lever arrangement including a pedal such that when the lower end of the stem is inserted into the ground and with the pedal engaging the ground, downward pressure on the handle and rotation of the stem relative to the cover and lever arrangement causes the cover to move away from the opening so that a group of seeds passed by operation of a valve member which occurs simultaneously with the rotation of the stem causes the group of seeds to pass through the opening into the ground.

Bonneault is unsuitable for use as a walking aid, and is of a complicated structure embodying a ground-engaging pedal for its operation but demonstrates the possibility that downward pressure on the handle of a walking aid could be employed to operate a lever or cover pivotally mounted at the foot of the stem of the walking aid.

SUMMARY OF THE INVENTION

According to the invention there is provided a walking aid comprising a body, a ground engaging member mounted at one end of the body, the body being movable relative to the ground engaging member, and a lever pivotably mounted on said ground engaging member, the body having means to actuate the lever so as to cause pivotal movement of the lever when the body moves relative to the ground engaging member, whereby an object on the ground may subsequently be retrieved by a gripping action between the lever and the ground engaging member, the walking aid comprising selectively operable means for preventing relative movement of the body and the ground engaging member. The body of the walking aid may be a walking stick, crutch or walking frame. Alternatively, the body is provided with means for attachment to the bottom of a walking stick crutch or walking frame.

This pivotal movement of the lever can be utilised for retrieving objects, with the lever and ground-engaging member acting as gripping members, the pivotal movement in one sense causing the gripping members to open and pivotal movement in the opposite sense causing the gripping members to close. The lever acts as a movable gripping member, the other gripping member being stationary.

A walking aid according to the invention is readily operable by downward pressure on the body of the walking aid.

The provision of the selectively operable means enables the user to select whether the walking aid is to be used "normally", in which case said means is operative to prevent relative movement of the body and the groundengaging member, or whether the walking aid is to be used for retrieving objects.

Conveniently, the selectively operable means comprises a ring rotatably disposed between the body and the groundengaging member and a projection carried by the body which is normally on the side of the ring remote from the ground engaging member, the ring having a slit for the passage of the projection so as to allow movement of the body relative to the ground engaging member.

The relative movement of the body may be limited by the engagement of the projection with the ground engaging member.

The body may extend into the ground engaging member to provide a space-saving construction.

The actuating means may comprise a projection extending substantially perpendicularly to the longitudinal direction of movement of the body.

Suitably, the lever comprises a U-shaped portion having arms between which the projection is located.

In one embodiment, the walking aid comprises biasing means which resists a downward movement of the body relative to the ground engaging member so that after the body has been pressed downwardly relative to the ground engaging member from a rest position the biasing means can urge the body back into its rest position.

Suitably, the biasing means is a compression spring having one end engaging the ground engaging member and the other end engaging the body.

In one form of construction, the ground engaging member comprises a ground engaging cup of resilient material and a tubular member received within the cup, the lever being pivotably mounted on the tubular member.

DETAILED DESCRIPTION OF THE PREFERRED EMBODIMENT

Figure 2:
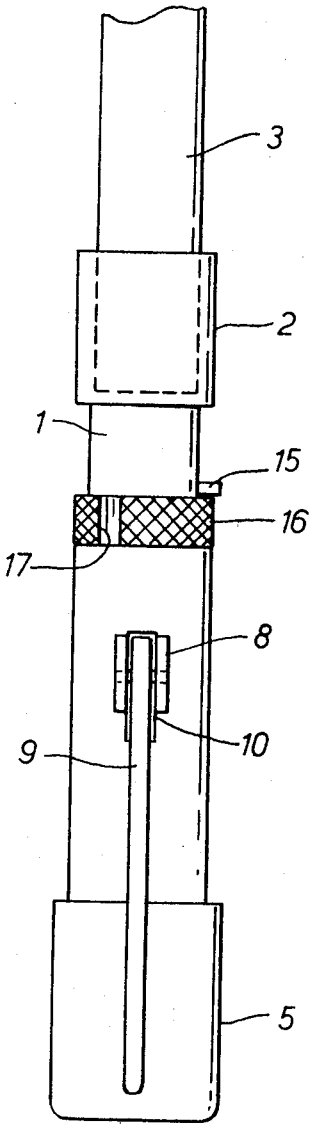
FIG. 2 is a side view of the walking aid of FIG. 1 as seen from the left-hand side of FIG. 1

Referring to the drawings, an elongate tubular body 1 is provided with a receptacle 2 for receiving the shaft 3 of a conventional walking aid (not shown) such as a walking stick, crutch or walking frame. The body 1 extends within a ground engaging member 4 which comprises a ground engaging cup 5 of resilient material such as rubber or plastics and a tubular member 6 which extends into the cup 5. A compression spring 7 is located below the body 1 with one end engaging the body 1 and with one end engaging the cup 5. A pair of ears 8 is secured to the tubular member 6 and a lever 9 is pivotably mounted between the ears 8. The tubular member 6 is formed with a slit 10 between the ears 8 as shown in FIG. 2 and slit 10 is in registry with a slit 11 formed in the body 1. A pin 12 extends diametrically across the interior of the body 2 and is engaged by the arms 13 of a U-shaped portion 14 of the lever 9 which extends through the slits 10 and 11.

Figure 1:
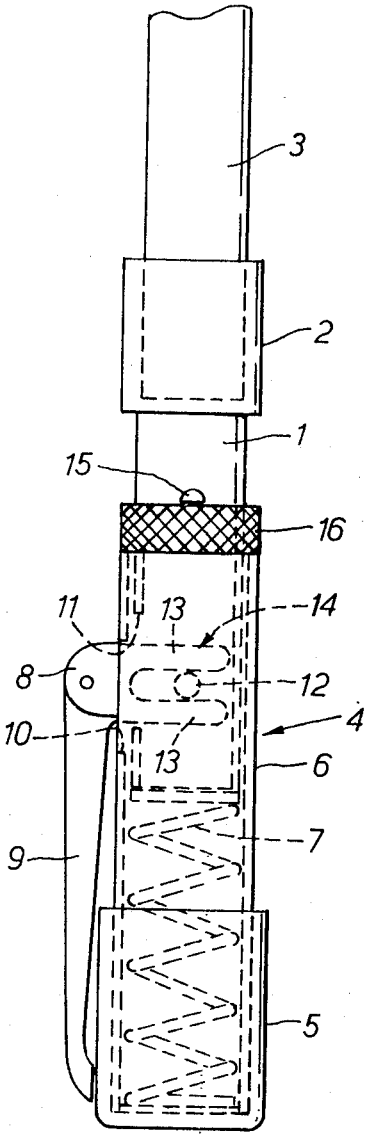
FIG. 1 is a side view of part of a walking aid in its normal position.

In the normal position of the walking aid shown in FIG. 1, movement of the body 1 relative to the groundengaging member 4 is prevented by a pin 15 extending transversely of the body 1 and engaging a rotatably mounted ring 16. The ring 16 is located between the pin 15 and the upper surface of the tubular member 6. The ring 16 is provided with a slit 17 as shown in FIG. 2.

Figure 3:
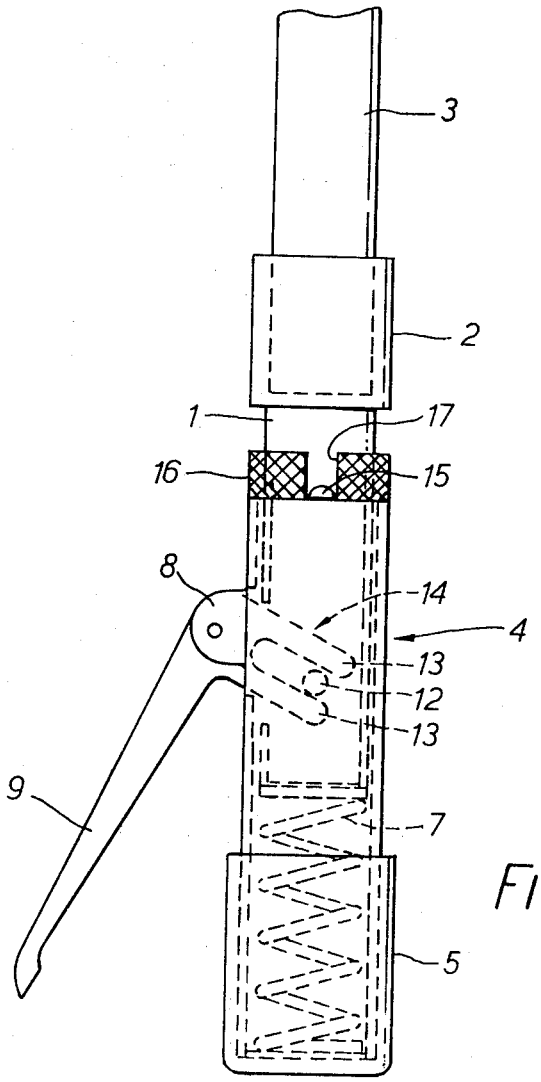
FIG. 3 is a side view similar to that of FIG. 1 but showing the walking aid in an actuated position.

To use the walking aid to pick up objects, the user rotates the ring 16 to the position shown in FIG. 3 where the pin 15 is in registry with the slit 17. The user then presses the walking aid against the ground so that the cup 5 is adjacent the object (not shown) to be retrieved. This causes the pin 15 to pass through the slit 17 until the pin 15 engages the upper surface of the tubular member 6 as shown in FIG. 3. The downward movement of the body 1 into the tubular member 6 causes the pin 12 to engage the arms 12 of the lever 9 and to rotate the lever 9 to the position shown in FIG. 3 against the bias of the spring 7. On releasing the applied pressure, the arm 9 returns to (or towards) the position shown in FIGS. 1 and 2 gripping the object between the lever 9 and the cup 5. The user may then raise the walking aid, remove the object trapped between the lever 9 and the cup 5. The user may then use the walking aid to pick up further objects or return the ring 16 to the position shown in FIGS. 1 and 2 so that the walking aid may be used in the normal way.

It will be appreciated that in a modification not shown the elongate body 1 may itself form a shank of the walking aid and that the receptacle 2 may then be dispensed with. The surface of the ring 16 is preferably knurled as shown to enable the user to rotate the ring more easily.

What is claimed is:

1. A walking aid comprising a body, a ground engaging member mounted at one end of the body, the body being movable relative to the ground engaging member, and a lever pivotably mounted on said ground engaging member, the body having means to actuate the lever so as to cause pivotal movement of the lever when the body moves relative to the ground engaging member, whereby an object on the ground may subsequently be retrieved by a gripping action between the lever and the ground engaging member, the walking aid comprising selectively operable means for preventing relative movement of the body and the ground engaging member, wherein said selectively operable means comprises a ring rotatably disposed between the body and the ground engaging member and a projection carried by the body which is normally on the side of the ring remote from the ground engaging member, the ring having a slit for the passage of the projection so as to allow movement of the body relative to the ground engaging member.

2. A walking aid as defined in claim 1, wherein the relative movement of the body is limited by the engagement of the projection with the ground engaging member.

3. A walking aid comprising a body, a ground engaging member mounted at one end of the body, the body being movable relative to the ground engaging member, and lever pivotably mounted on said ground engaging member, the body having means to actuate the lever so as to cause pivotal movement of the lever when the body moves relative to the ground engaging member, whereby an object on the ground may subsequently be retrieved by a gripping action between the lever and the ground engaging member, the walking aid comprising selectively operable means for preventing relative movement of the body and the ground engaging member, wherein the actuating means comprises a projection extending substantially perpendicularly to the longitudinal direction of movement of the body.

4. A walking aid as defined in claim 3, wherein the lever comprises a U-shaped portion having arms between which the projection is located.

5. A walking aid comprising a body, a ground engaging member mounted at one end of the body, the body being movable relative to the ground engaging member, and a lever pivotably mounted on said ground engaging member, the body having means to actuate the lever so as to cause pivotal movement of the lever when the body moves relatively to the ground engaging member, whereby an object on the ground may subsequently be retrieved by a gripping action between the lever and the ground engaging member, the walking aid comprising selectively operable means for preventing relative movement of the body and the ground engaging member, comprising biasing means which resists a downward movement of the body relative to the ground engaging member so that after the body has been pressed downwardly relative to the ground engaging member from a rest position the biasing means can urge the body back to its rest position.

6. A walking aid as defined in claim 5, wherein the biasing means is a compression spring having one end engaging the ground engaging member and the other end engaging the body.

* * * * *